US005964037A

United States Patent [19]

Clark

[11] Patent Number: 5,964,037

[45] Date of Patent: Oct. 12, 1999

[54] HAIR CLIPPER BLADE SYSTEM FOR PRODUCING A FADE HAIRCUT

[76] Inventor: Reginald Clark, 1123 W. Arbutus St., Compton, Calif. 90220

[21] Appl. No.: 09/106,977

[22] Filed: Jun. 29, 1998

[51] Int. Cl.[6] ..... B26B 19/06

[52] U.S. Cl. ..... 30/223; 30/210; 30/216

[58] Field of Search ..... 30/210, 216, 233, 30/233.5, 223, 225, 34.1, 43.92

[56] References Cited

U.S. PATENT DOCUMENTS

| | | | |
|---|---|---|---|
| D. 260,562 | 9/1981 | Mack | D28/53 |
| 976,581 | 11/1910 | Kuhle | 30/225 X |
| 1,440,015 | 12/1922 | Kaniefski | 30/233.5 X |
| 1,454,458 | 5/1923 | Smith | 30/233.5 |
| 1,639,617 | 8/1927 | Seavey | 30/233.5 |
| 3,986,258 | 10/1976 | Liedtke | 30/30 |
| 4,221,050 | 9/1980 | Walter | 30/216 |
| 4,458,417 | 7/1984 | Andis | 30/216 |
| 4,493,149 | 1/1985 | Tanahashi | 30/43.92 |
| 4,899,444 | 2/1990 | Trichell | 30/208 |
| 5,426,856 | 6/1995 | Aiyama et al. | 30/233 X |
| 5,819,415 | 10/1998 | Bruggers et al. | 30/210 X |

*Primary Examiner*—Douglas D. Watts
*Attorney, Agent, or Firm*—Goldstein & Canino

[57] ABSTRACT

A set of hair cutting blades, for use with an electric buzzer, comprising at least one upper blade and at least one lower blade. The upper blade has a plurality of upper teeth, and has a short side and a long side. The upper teeth vary in length such that they gradually increase in length between the short side and the long side. The upper teeth also vary in height such that they gradually increase in height between the short side and the long side. The lower blade has lower teeth which are uniform in both length and height. The upper blade is mounted to the buzzer directly over the lower blade and the blades are reciprocated against each other to create a cutting action. By a preferred embodiment, left and right facing upper blades are provided which form a mirror image of each other such that among both of said blades the short side and long side are reversed.

4 Claims, 2 Drawing Sheets

HAIR CLIPPER BLADE SYSTEM FOR PRODUCING A FADE HAIRCUT

BACKGROUND OF THE INVENTION

The invention relates to a hair clipper blade system. More particularly, the invention relates to a system of hair clipper blades which are specifically configured to produce a fade haircut.

In recent years, buzzed haircuts have become increasingly popular. A buzzer, also known as a clipper or shearer, employs a pair of blades which are electrically reciprocated to rub against each other to create a cutting action. When used properly, the buzzer can create straight line cuts which could not otherwise be accomplished with a pair of scissors.

However, recent trends have produced haircuts which involve more than simple straight line buzzes. Fade haircuts in particular create the desired effect by producing an area of gradually tapered hair. To correctly create the desired effect, the buzzer must be handled with great skill to ensure that the angled cuts are consistent. Otherwise, an uneven look might be created.

Therefore, the problem with creating these haircuts with current buzzers and standardly available buzzer blades, is that they require a steady hand and a great deal of time and skill to ensure that they are done correctly.

Some comb attachments are available which are interchangeable to allow different length cuts to be attained. While these units may be suitable for the particular purpose employed, or for general use, they would not be as suitable for the purposes of the present invention as disclosed hereafter.

SUMMARY OF THE INVENTION

It is an object of the invention to produce a set of hair clipper blades which are capable of producing a buzzed hair cut. Accordingly, top and bottom blades are provided for use with conventional hair buzzers.

It is another object of the invention to provide a set of hair clipper blades which are capable of creating angled cuts necessary to accomplish a fade haircut. Accordingly, the blades have a cutting surface which includes blades having teeth which simultaneously increase in both length and thickness to provide a two dimensionally tapered cutting surface.

It is a still further object of the invention that the blades are provided have distinct cutting surfaces for use in cutting both the left and right sides of the head.

It is yet a further object of the invention that the left and right facing cutting surfaces may be combined onto a single blade.

The invention is a set of hair cutting blades, for use with an electric buzzer, comprising at least one upper blade and at least one lower blade. The upper blade has a plurality of upper teeth, and has a short side and a long side. The upper teeth vary in length such that they gradually increase in length between the short side and the long side. The upper teeth also vary in height such that they gradually increase in height between the short side and the long side. The lower blade has lower teeth which are uniform in both length and height. The upper blade is mounted to the buzzer directly over the lower blade and the blades are reciprocated against each other to create a cutting action. By a preferred embodiment, left and right facing upper blades are provided which form a mirror image of each other such that among both of said blades the short side and long side are reversed.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
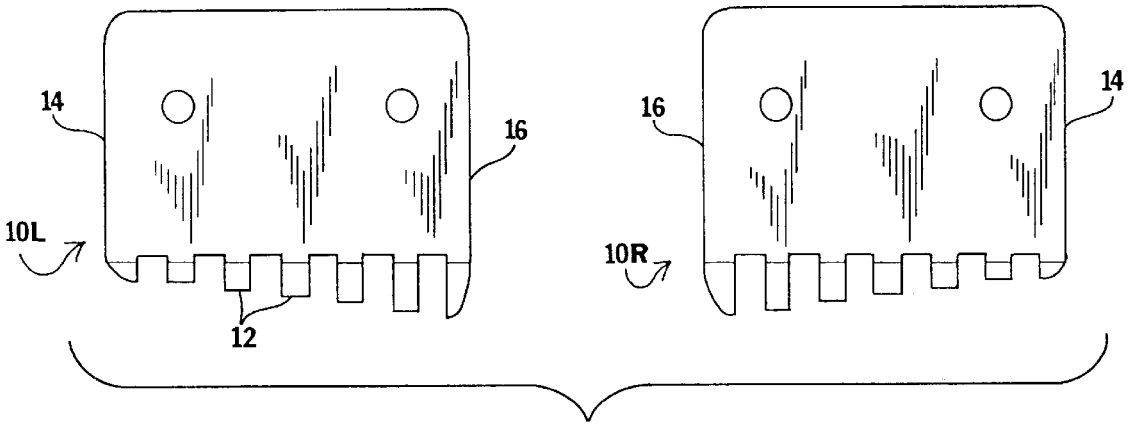
FIG. 1 is a top plan view illustrating the left facing and right facing upper blades.

FIG. 1 illustrates an upper left blade 10L and an upper right blade 10R. Each of the upper blades 10L and 10R have a plurality of upper teeth 12, have a short side 14 and a long side 16. The upper teeth 12 vary in length, continually increasing in length between the short side 14 and long side 16. The overall variation in length between the upper teeth 12 at the short side 14 and the upper teeth 12 at the long side 16 is approximately one quarter inch.

Figure 2:
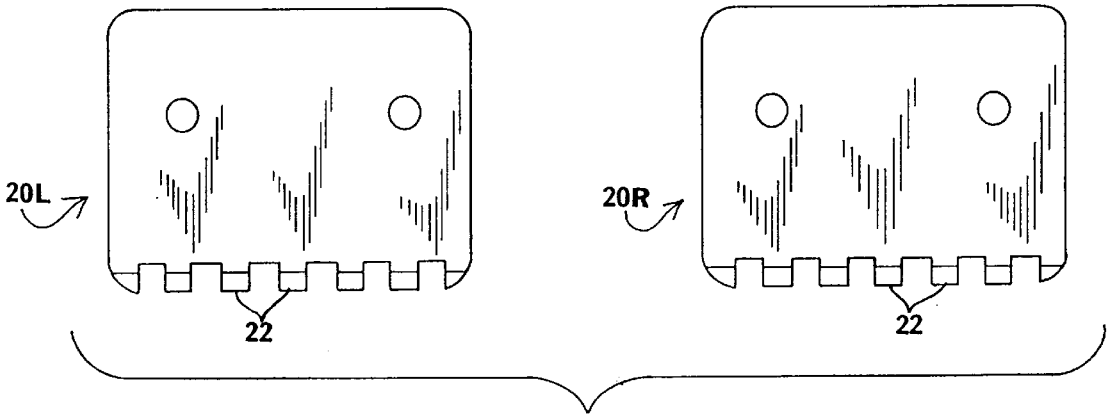
FIG. 2 is a top plan view illustrating the left facing and right facing lower blades.

Referring to FIG. 2, a lower left blade 20L and lower right blade 20R are illustrated. The lower blades 20L and 20R have lower teeth 22. The lower teeth 22 are uniform in length.

Figure 3:
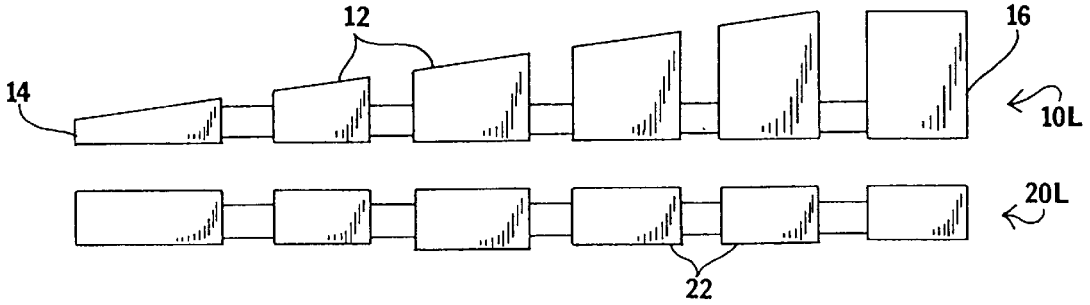
FIG. 3 is a front elevational view of the left facing upper blade aligned directly over the left lower blade.

Referring to FIG. 3, the upper left blade 10L and the lower left blade 20L are shown from the front, wherein the upper left blade 10L and lower left blade 20L are located directly above one another. As illustrated, the lower teeth 22 are uniform in height. However, the upper teeth 12 vary in height between the short side 14 and the long side 16. In fact, the upper teeth 12 continually increase in height between the short side 14 and long side 16. The overall variation in height between the upper teeth 12 at the short side 14 and the upper teeth 12 at the long side 16 is approximately one quarter inch.

Figure 4:
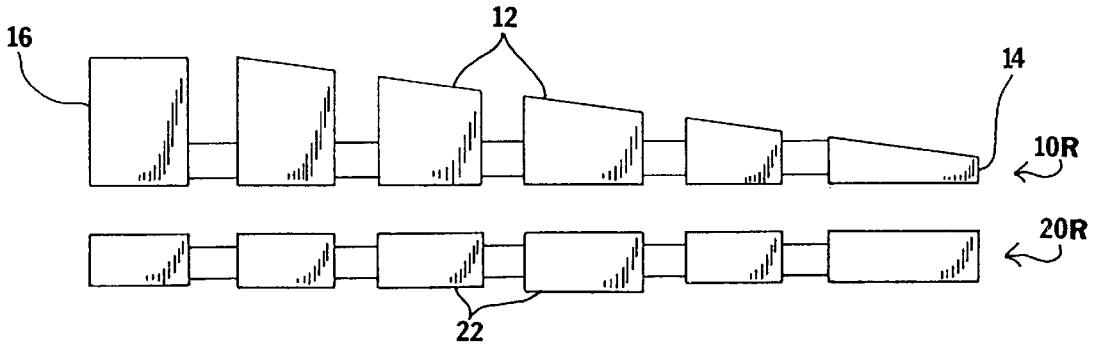
FIG. 4 is a front elevational view of the right facing upper blade aligned directly over the right lower blade.

FIG. 4 illustrates the upper right blade 10R and the lower right blade 20R, shown from the front, wherein the upper right blade 10R and lower right blade 20R are located directly above one another. As illustrated, the lower teeth 22 are uniform in height. However, the upper teeth 12 vary in height between the short side 14 and the long side 16. In fact, the upper teeth 12 continually increase in height between the short side 14 and long side 16. The overall variation in height between the upper teeth 12 at the short side 14 and the upper teeth 12 at the long side 16 is approximately one quarter inch. In general, the upper right blade 10R and lower right blade 10L are mirror images of each other, wherein among both said blades, the short side and long side are reversed.

In operation, each pair of either left or right upper and lower blades are attached onto the buzzer, and are used to provide buzz cuts on either the left or right side of the head to provide the desired fade effect. It should be noted that with a buzzer that allows a double sided blade, the arrangement of upper teeth 12 on both the upper right blade 10R and upper left blade 10L can be combined onto opposite sides of the same blade.

In conclusion, herein is provided a set of blades which include upper blades which have teeth that are tapered both in height and in length between a short side and a long side, to effectively allow a fade haircut to be produced quickly and precisely.

What is claimed is:

1. A set of hair cutting blades, for use with an electric buzzer, comprising:

an upper blade having a plurality of upper teeth, a short side and a long side, the upper teeth vary in length whereas the teeth gradually increase in length between the short side and long side, the upper teeth vary in height whereas the teeth gradually increase in height between the short side and long side; and a lower blade, the lower blade having a plurality of lower teeth which are uniform in length and in height, the upper blade and lower blade are attached onto the electric trimmer where the upper blade is located directly over the lower blade such that the upper blade and lower blade are reciprocated to rub against each other to provide a cutting action.

2. The set of hair cutting blades as recited in claim 1, wherein the upper blade further comprises a pair of upper blades consisting of a left upper blade and a left lower blade, among which the short side and long side are reversed.

3. The set of hair cutting blades as recited in claim 2, wherein the overall difference in length between the upper teeth at the short side and the upper teeth at the long side is substantially one quarter inch.

4. The set of hair cutting blades as recited in claim 3, wherein the overall difference in height between the upper teeth at the short side and the upper teeth at the long side is substantially one quarter inch.

* * * * *